US010934687B2

(12) United States Patent
Young

(10) Patent No.: US 10,934,687 B2
(45) Date of Patent: Mar. 2, 2021

(54) HYDRAULIC POWER PRIORITIZATION

(71) Applicant: Clark Equipment Company, West Fargo, ND (US)

(72) Inventor: Charles Young, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/522,208

(22) Filed: Jul. 25, 2019

(65) Prior Publication Data

US 2020/0032486 A1 Jan. 30, 2020

Related U.S. Application Data

(60) Provisional application No. 62/703,119, filed on Jul. 25, 2018.

(51) Int. Cl.

| | |
|---|---|
| ***E02F 9/22*** | (2006.01) |
| ***F15B 11/17*** | (2006.01) |
| ***F15B 11/16*** | (2006.01) |

(52) U.S. Cl.

CPC ..... *E02F 9/2296* (2013.01); *E02F 9/2235* (2013.01); *E02F 9/2253* (2013.01); *E02F 9/2264* (2013.01); *E02F 9/2292* (2013.01); *F15B 11/162* (2013.01); *F15B 11/165* (2013.01); *F15B 11/17* (2013.01); *F15B 2211/20546* (2013.01)

(58) Field of Classification Search

CPC ..... F15B 11/161; F15B 11/162; F15B 11/165; F15B 11/17; E02F 9/2253; E02F 9/2292; E02F 9/2296

See application file for complete search history.

(56) References Cited

U.S. PATENT DOCUMENTS

| | | | | |
|---|---|---|---|---|
| 4,087,968 | A | 5/1978 | Bianchetta | |
| 4,369,625 | A * | 1/1983 | Izumi | E02F 9/2292 414/699 |
| 4,534,707 | A | 8/1985 | Mitchell | |
| 4,712,376 | A | 12/1987 | Hadank et al. | |
| 4,819,430 | A | 4/1989 | Becker | |
| 5,029,067 | A * | 7/1991 | Nishida | E02F 9/2004 60/421 |
| 5,131,227 | A | 7/1992 | Iseman | |
| 5,918,558 | A | 7/1999 | Susag | |
| 6,769,348 | B2 | 8/2004 | Hudson et al. | |
| 7,234,298 | B2 | 6/2007 | Brinkman et al. | |
| 7,386,978 | B2 * | 6/2008 | Ivantysynova | E02F 9/2235 60/434 |
| 8,720,197 | B2 | 5/2014 | Persson et al. | |
| 8,756,930 | B2 | 6/2014 | Johnson et al. | |
| 8,793,023 | B2 | 7/2014 | Vanderlaan et al. | |

(Continued)

OTHER PUBLICATIONS

International Search Report and Written Opinion for International Application No. PCT/US2019/043444 filed Jul. 25, 2019, 13 pages.

*Primary Examiner* — Michael Leslie
(74) *Attorney, Agent, or Firm* — John Veldhuis-Kroeze; Westman, Champlin & Koehler, P.A.

(57) ABSTRACT

Disclosed embodiments include power machines, and hydraulic systems for power machines, in which a controller is configured to monitor the power in each of an implement circuit and a drive circuit and to adjust pump flow to manage engine power consumption.

14 Claims, 4 Drawing Sheets

(56) References Cited

U.S. PATENT DOCUMENTS

| | | | | |
|---|---|---|---|---|
| 9,211,808 | B2 * | 12/2015 | Young | B60W 10/06 |
| 9,416,799 | B2 | 8/2016 | Danzl et al. | |
| 9,725,883 | B2 * | 8/2017 | Drake | B60K 6/12 |
| 9,845,589 | B2 | 12/2017 | Tsuruga et al. | |
| 9,845,590 | B2 | 12/2017 | Spielman | |
| 2006/0182636 | A1 | 8/2006 | Ivantysynova et al. | |
| 2013/0226415 | A1 | 8/2013 | Smith et al. | |
| 2013/0238178 | A1 | 9/2013 | Young | |
| 2014/0129035 | A1 | 5/2014 | Marquette et al. | |
| 2017/0284316 | A1 | 10/2017 | Hansen et al. | |

* cited by examiner

HYDRAULIC POWER PRIORITIZATION

CROSS-REFERENCE TO RELATED APPLICATION

This application claims the benefit of U.S. Provisional Application No. 62/703,119, which was filed on Jul. 25, 2018.

BACKGROUND

The present disclosure is directed toward power machines. More particularly, the present disclosure is directed toward hydraulic systems of power machines such as loaders.

Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Power machines typically include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a drive or motive system for moving the power machine under power. Typically, another work element is an implement system, including the implement which performs a work function and lift arms or other elements which move the implement to work positions. The power source for providing power to the work elements of a power machine typically include hydraulic systems, powered by an engine of the power machine, which provide pressurized hydraulic fluid or oil to the drive system and the implement system. Under certain conditions, the combined flows of oil to the drive system and implement system result in more engine power consumption than is required or desired.

The discussion above is merely provided for general background information and is not intended to be used as an aid in determining the scope of the claimed subject matter.

SUMMARY

This Summary and the Abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Disclosed embodiments include power machines, such as loaders, and hydraulic systems which prioritize power consumption between an implement circuit and a drive circuit. A system of one or more controllers or computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect includes a power machine (100; 200; 300) having a frame (110; 210), an engine (360) supported by the frame, and further including: a structure (272) for receiving one of a plurality of attachable implements capable of being operated by the power machine; an implement circuit (320) configured to selectively provide power to an implement that is operably coupled to the power machine; an implement pump (310) driven by the engine and configured to supply a first variable displacement flow of pressurized hydraulic fluid to the implement circuit; a drive circuit (325) including at least one drive motor; a drive pump (315) driven by the engine and configured to supply a second variable displacement flow of pressurized hydraulic fluid to the drive circuit; and a controller (335) coupled to the implement pump (310) and the drive pump (315) and configured to selectively provide power to the implement circuit and the drive circuit in response to signals from user input devices (340), the controller being configured to monitor power in each of the implement circuit (320) and the drive circuit (325) and to generate control signals to control prioritization of flow of hydraulic fluid to the implement circuit and to the drive circuit by individually controlling the first variable displacement flow of the implement pump (310) and the second variable displacement flow of the drive pump (315) in order to manage engine power consumption.

Implementations may include one or more of the following features. The power machine where the controller is configured to control prioritization of flow of hydraulic fluid to the implement circuit (320) and to the drive circuit (325) as a function of a working mode of the power machine.

The power machine where the controller is configured such that, when the controller, in response to signals from user input devices, makes power available for the attached implement, power to the implement circuit (320) is prioritized higher than any power that is provided to the drive circuit (325) and the controller controls the drive pump (315) to reduce the second variable displacement flow of the drive pump.

The power machine and further comprising: a lift arm assembly (230) pivotally coupled to the frame; an implement carrier (272) pivotally coupled to the lift arm assembly and configured to have an implement coupled thereto; and wherein the implement circuit further includes: a lift actuator (238), coupled between the frame and the lift arm assembly and configured to raise and lower the lift arm assembly; and a tilt actuator (235) pivotally coupled between the lift arm assembly and the implement carrier and configured to rotate the implement carrier relative to the lift arm assembly.

The power machine where the controller is further configured such that, when the controller is free from any signals form user input devices to provide power to the implement that is operably coupled to the power machine, power to the drive circuit (325) is prioritized higher than power to the implement circuit (320) and the controller controls the implement pump (310) to reduce the first variable displacement flow of the implement pump.

The power machine where the controller is configured to control prioritization of flow of hydraulic fluid to the implement circuit (320) and to the drive circuit (325) at all times during power machine operation.

The power machine where the controller is configured to control prioritization of flow of hydraulic fluid to the implement circuit (320) and to the drive circuit (325) only when power, commanded by an operator using the user input, to be provided to one or both of the implement circuit (320) and the drive circuit (325), is greater than a capacity of the engine (305).

The power machine and further comprising: a first sensor (345) configured to monitor power in the implement circuit (320) and a second sensor (350) configured to monitor power in the drive circuit (325), the first and second sensors providing feedback to controller (335) for use in generating control signals for controlling implement pump (310) and drive pump (315).

One general aspect includes a power machine (100; 200; 300) comprising: a frame (110; 210); an engine (360); a lift arm assembly (230) pivotally coupled to the frame; and an implement carrier (272) pivotally coupled to the lift arm assembly and configured to have an implement coupled thereto. The power machine further includes an implement circuit (320), comprising: a lift actuator (238), coupled between the frame and the lift arm assembly and configured to raise and lower the lift arm assembly; and a tilt actuator (235) pivotally coupled between the lift arm assembly and the implement carrier and configured to rotate the implement carrier relative to the lift arm assembly; and auxiliary hydraulic components including any implement actuator of the implement coupled to the implement carrier. The power machine further comprises an implement pump (310) driven by the engine and configured to supply a first variable displacement flow of pressurized hydraulic fluid to the implement circuit; a drive circuit (325) including at least one drive motor; a drive pump (315) driven by the engine and configured to supply a second variable displacement flow of pressurized hydraulic fluid to the drive circuit; and a controller (335) coupled to the implement pump (310) and the drive pump (315), the controller configured to generate control signals to control the implement pump and the drive pump to prioritize flow of hydraulic fluid to the implement circuit (320) and to the drive circuit (325) by individually controlling the first variable displacement flow of the implement pump and the second variable displacement flow of the drive pump.

Implementations may include one or more of the following features. The power machine where the controller is configured to generate the control signals to control the implement pump and the drive pump to prioritize flow of hydraulic fluid to the implement circuit (320) and to the drive circuit (325) as a function of a working mode of the power machine.

The power machine where the controller is configured such that, when the auxiliary hydraulic components including any implement actuator of the implement coupled to the implement carrier are turned on or flow of hydraulic fluid is being directed to the auxiliary hydraulic components, power to the implement circuit (320) is prioritized higher than power to the drive circuit (325) and the controller generates the control signals to control the drive pump (315) to reduce the second variable displacement flow of the drive pump.

The power machine where the controller is further configured such that, when the auxiliary hydraulic components including any implement actuator of the implement coupled to the implement carrier are turned off and flow of hydraulic fluid is not being directed to the auxiliary hydraulic components, power to the drive circuit (325) is prioritized higher than power to the implement circuit (320) and the controller generates the control signals to control the implement pump (310) to reduce the first variable displacement flow of the implement pump.

The power machine and further comprising a user input (340) coupled to the controller (335) and configured to command that power be supplied, in the form of flow of hydraulic fluid, to one or both of the implement circuit (320) and the drive circuit (325).

The power machine where the controller is configured to prioritize flow of hydraulic fluid to the implement circuit (320) and to the drive circuit (325) at all times during power machine operation.

The power machine where the controller is configured to prioritize flow of hydraulic fluid to the implement circuit (320) and to the drive circuit (325) only when power, commanded by an operator using the user input, to be provided to one or both of the implement circuit (320) and the drive circuit (325), is greater than a capacity of the engine (305).

The power machine and further comprising a first sensor (345) configured to monitor power in the implement circuit (320) and a second sensor (350) configured to monitor power in the drive circuit (325), the first and second sensors providing feedback to controller (335) for use in generating the control signals for controlling implement pump (310) and drive pump (315).

Disclosed embodiments include power machines, and hydraulic systems for power machines, in which a controller is configured to monitor the power in each of an implement circuit and a drive circuit and to adjust pump flow to manage engine power consumption.

DESCRIPTION

The concepts disclosed in this discussion are described and illustrated by referring to illustrative embodiments. These concepts, however, are not limited in their application to the details of construction and the arrangement of components in the illustrative embodiments and are capable of being practiced or being carried out in various other ways. The terminology in this document is used to describe illustrative embodiments and should not be regarded as limiting. Words such as "including," "comprising," and "having" and variations thereof as used herein are meant to encompass the items listed thereafter, equivalents thereof, as well as additional items.

Disclosed embodiments are directed to power machines having hydraulic systems which direct hydraulic power to an implement system or circuit including lift arm and auxiliary implement functions, and to a drive system or circuit. In exemplary embodiments, an electronic controller monitors the power in each of the implement and drive circuits, and adjusts pump flow to manage engine power consumption.

Figure 2:
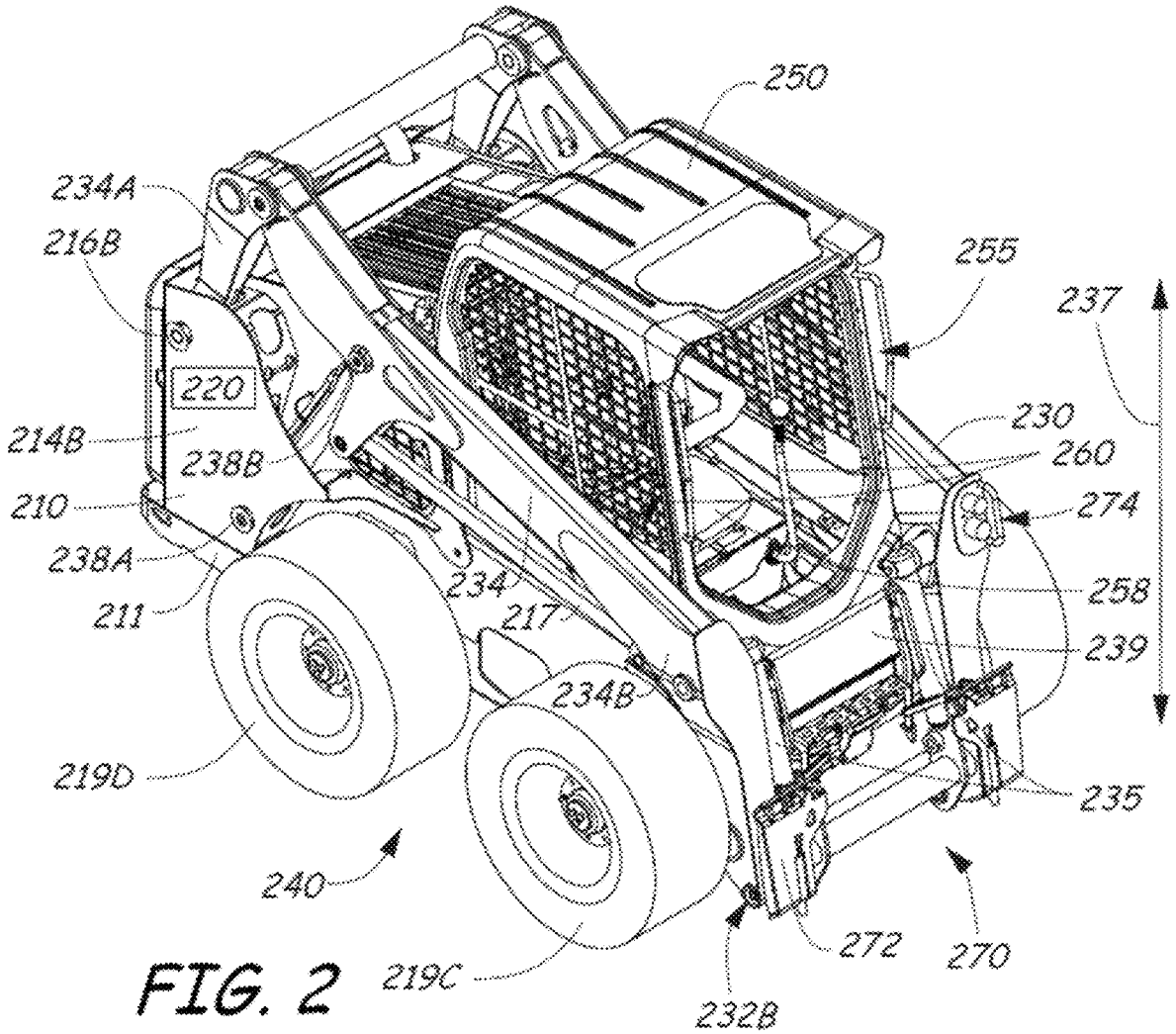
FIG. 2 is a front perspective view of a power machine on which embodiments disclosed herein can be advantageously practiced.
Figure 3:
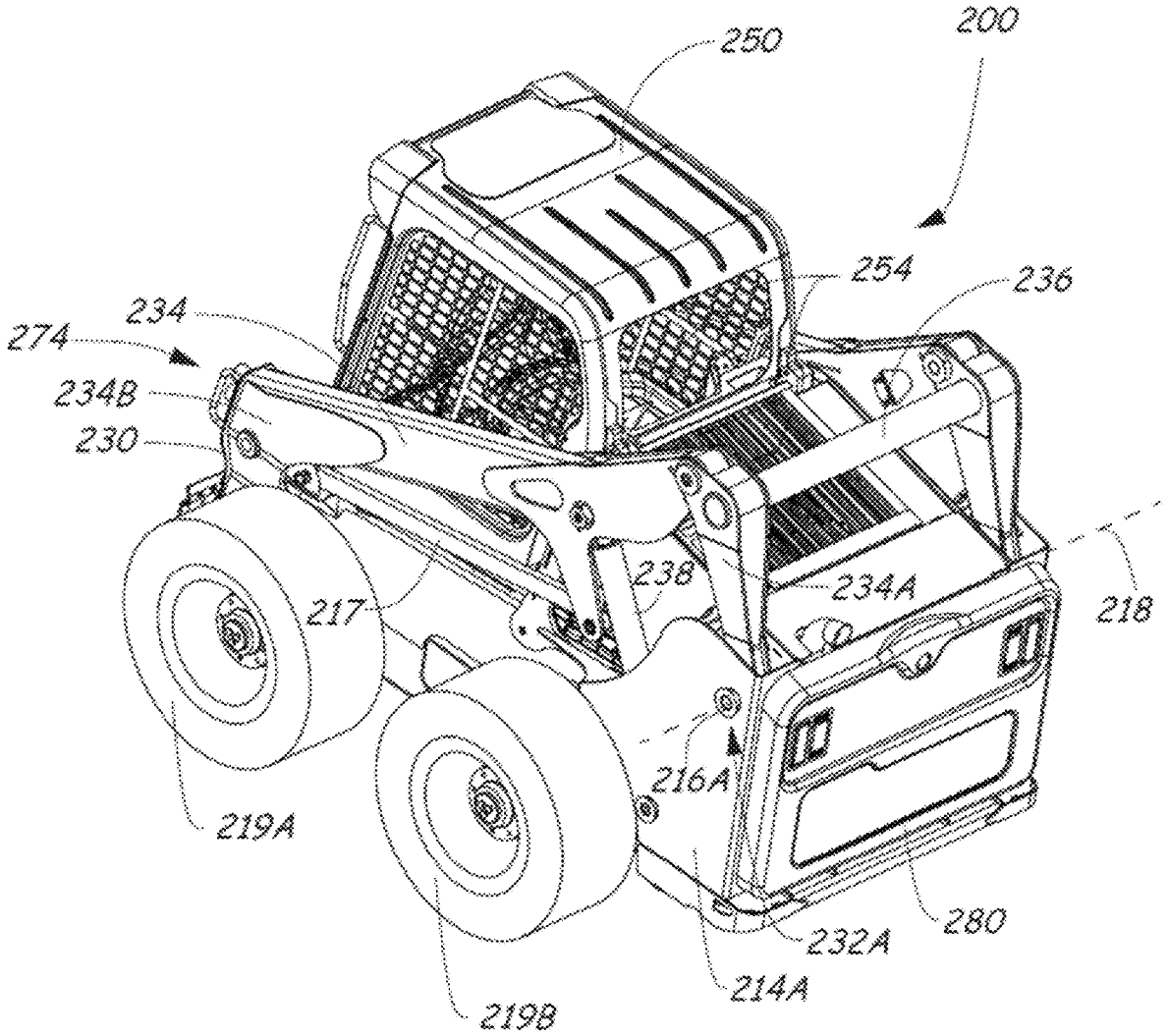
FIG. 3 is a rear perspective view of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine (i.e., a skid-steer loader) is illustrated and discussed as being a representative power machine. However, as mentioned above, the embodiments below can be practiced on various types of power machines, including power machines of different types from the representative power machine shown in FIGS. 2-3.

Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
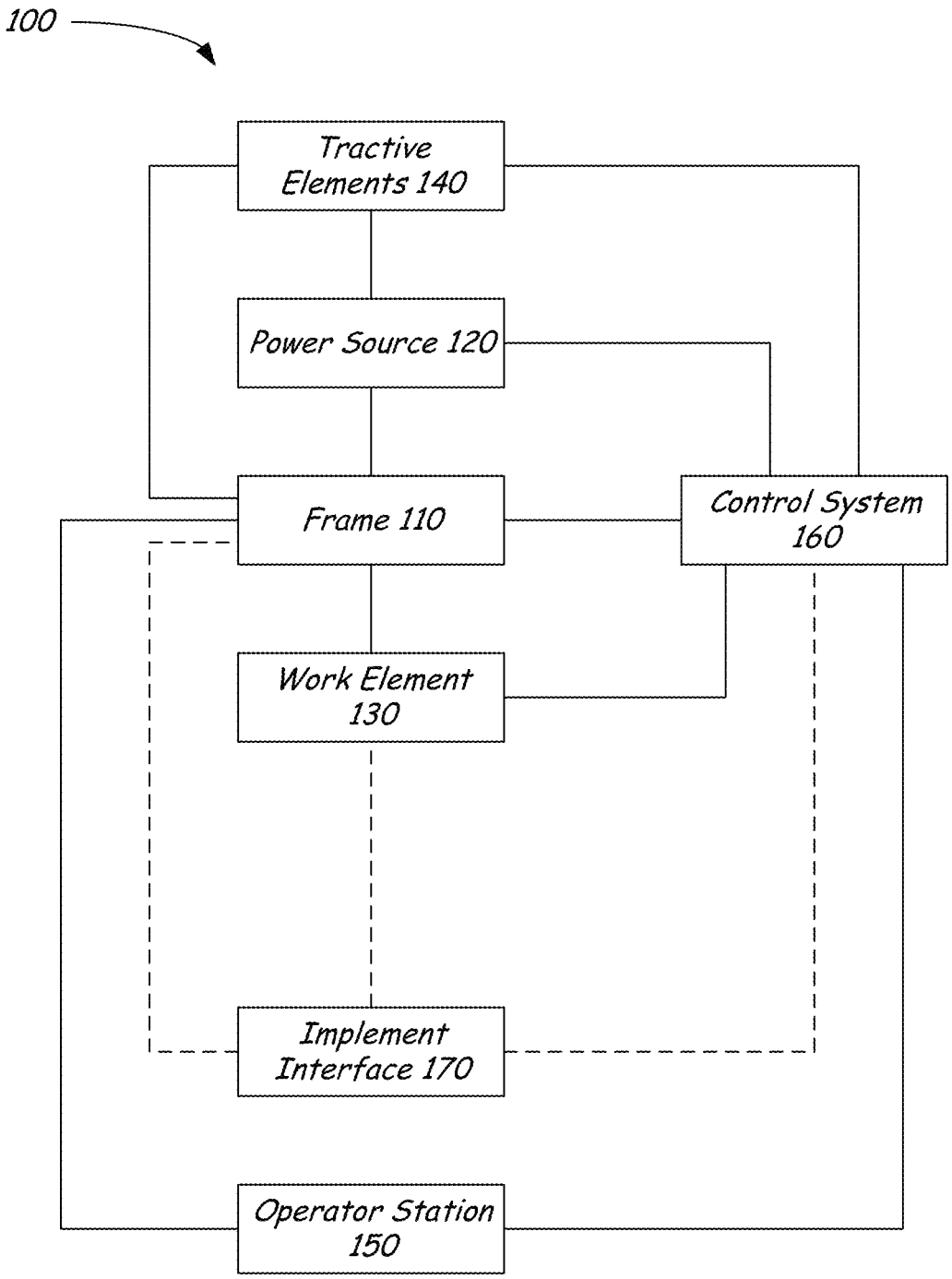
FIG. 1 is a block diagram illustrating functional systems of a representative power machine on which embodiments of the present disclosure can be advantageously practiced.

FIG. 1 shows a block diagram illustrating the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. For the purposes of this discussion, the word "implement" refers to these types of attachable mechanisms. The word implement does not include actuators that manipulate the lift arm. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion (so-called articulated frames) for accomplishing steering functions.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 has an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, even if they have operator compartments or operator positions, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both the power machine and any implement to which is it coupled) that is capable of controlling at least some of the operator-controlled functions on the power machine.

FIGS. 2-3 illustrates a loader 200, which is one example of the power illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements.

The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220 that can generate or otherwise providing power for operating various functions on the power machine. Power system 220 is shown in block diagram form but is located within the frame 210. Frame 210 also supports a work element in the form of a lift arm assembly 230 that is powered by the power system 220 for performing various work tasks. As loader 200 is a work vehicle, frame 210 also supports a traction system 240, powered by power system 220, for propelling the power machine over a support surface. The power system 220 is accessible from the rear of the machine. A tailgate 280 covers an opening (not shown) that allows access to the power system 220 when the tailgate is an opened position. The lift arm assembly 230 in turn supports an implement interface 270 that provides attachment structures for coupling implements to the lift arm assembly.

The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair. The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 100 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that include and/or interact with the embodiments discussed below can have various frame components that support various work elements. The elements of frame 210 discussed herein are provided for illustrative purposes and frame 210 is not the only type of frame that a power machine on which the embodiments can be practiced can employ. The elements of frame 210 discussed herein are provided for illustrative purposes and is not necessarily the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200 is attached to the undercarriage 211 such as with fasteners or by welding the undercarriage to the mainframe. Mainframe 212 includes a pair of upright portions 214A and 214B located on either side and toward the rear of the mainframe that support lift arm structure 230 and to which the lift arm structure 230 is pivotally attached. The lift arm structure 230 is illustratively pinned to each of the upright portions 214A and 214B. The combination of mounting features on the upright portions 214A and 214B and the lift arm structure 230 and mounting hardware (including pins used to pin the lift arm structure to the mainframe 212) are collectively referred to as joints 216A and 216B (one is located on each of the upright portions 214) for the purposes of this discussion. Joints 216A and 216B are aligned along an axis 218 so that the lift arm structure is capable of pivoting, as discussed below, with respect to the frame 210 about axis 218. Other power machines may not include upright portions on either side of the frame or may not have a lift arm structure that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports tractive elements in the form of wheels 219A-D (collectively, 219) on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e. the lift arm assembly can be raised and lowered) under control of the loader 200 with respect to the frame 210 along a lift path 237 that forms a generally vertical path, although the path may not actually be exactly vertical. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e. along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is located proximal to a second end 232B of the lift arm assembly 234. The implement interface 270 includes an implement carrier 272 that is capable of accepting and securing a variety of different implements to the lift arm 230. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as skid-steer loader 200, unless otherwise noted or recited, the concepts discussed below are not intended to be limited in their application to the environments specifically described above.

Figure 4:
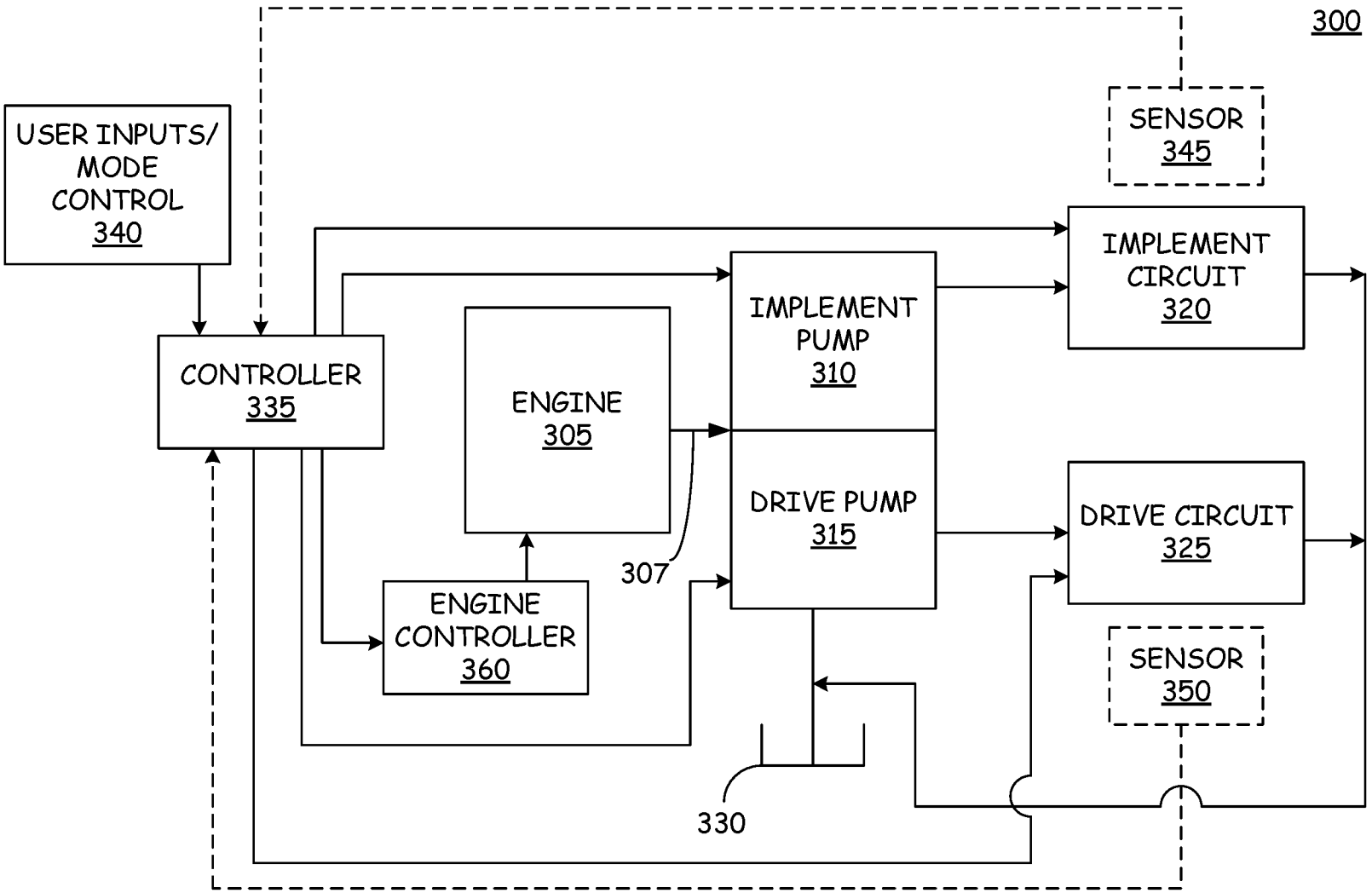
FIG. 4 is a block diagram of component systems of a power machine including a hydraulic power prioritization system.

Referring now to FIG. 4, shown is a block diagram of components of a power machine 300, such as power machines 100 and 200 discussed above, including an engine prioritization system according to one illustrative embodiment. FIG. 4 illustrates an engine 305 of the power machine 300, which drives an implement hydraulic pump 310 and a drive system hydraulic pump 315, using a rotational output shaft or member 307 of the engine. Engine 305 is an internal combustion engine, but in other embodiments, other types of engines or power sources may be employed. Drive pump 315 is a variable displacement hydrostatic pump configured to supply hydraulic power to drive motors for travel. Drive pump 315 is controlled responsive to electric signals from a controller 335, as discussed below. Although shown in FIG. 4 and discussed below as a drive pump, many embodiments can have a plurality of drive pumps. For example, skid steer loaders generally have two drive pumps, one to drive a left-hand side of the loader and one to drive the right-hand side of the loader. For simplicity's sake, the discussion below refers to a single drive pump even though many embodiments have at least two drive pumps. The drive motors and related components are shown as drive circuit 325. Instead of a conventional constant displacement gear pump, implement pump 310 is a variable displacement hydraulic pump configured in the system to provide hydraulic power to actuators for lift and implement tilt functions of a lift arm structure, as well to provide an auxiliary hydraulic power source for use with an attached implement. Displacement of implement pump 310 in the disclosed embodiments is controlled responsive to electrical signals provided by controller 335. Auxiliary power can be used on a variety of implements such as mowers, snow blowers, grapples, etc. The lift arm actuators and auxiliary hydraulic power provided to the implement are shown as implement circuit 320. As discussed above, the word implement refers only to those attached implements such as buckets, grapples, etc. However, the phrase "implement circuit" includes not only circuitry to control such implements, but can also include circuitry to control lift arm actuation (including lift arm actuators and tilt actuators). Hydraulic oil for pumps 310 and 315 can be provided from, and returned to, tank 330, although on machines with hydrostatic drive systems, the fluid from drive motors are returned to the drive pump 315 as a closed drive loop and oil is returned to the tank 330 from the drive loop via leakage in the drive pump 315 and drive circuit 325. Although not shown in FIG. 4, a charge pump draws hydraulic fluid from the tank 330 and provides it to the drive pump 315 to make up for the fluid lost from the closed loop through leakage. The path of hydraulic oil to pumps 310 and 315, as well as the paths through and from implement circuit 320 and drive circuit 325, can include various other components and be in different configurations from that illustrated in FIG. 4. The configuration of FIG. 4 is provided as an example, and is not intended to limit disclosed embodiments to a specific configuration.

User inputs 340, for example in the form of joystick controllers, switches, or other input devices, can be manipulated by an operator of the power machine to control modes of operation of the power machine. For example, user inputs 340 allow the user to control travel of the power machine, control movement of the lift arm assembly to place an attached implement at a desired work location, and to control movement or functions of the implement itself. Electronic controller 335 receives the user inputs, and responsively controls variable displacement pumps 310 and 315 to command required flow of pressurized hydraulic oil and accomplish the commanded tasks. Controller 335 can also control valves or other devices within implement circuit 320 and drive circuit 325 to accomplish the commanded tasks. In some embodiments, sensors 345 and 350 can be used to provide feedback to controller 335 for use in generating the control signals for controlling pumps 310 and 315 or circuits 320 and 325. For example, sensors 345 and 350 can be pressure sensors, position sensors, or other types of sensors used to monitor power in the circuits 320 and 325. However, sensors 345 and 350 are not required in all embodiments and controller 335 can be configured to provide control signals to pumps 310 and 315, and to circuits 320 and 325, based only upon the user inputs 340. Further, controller 335 controls the output of engine 305, for example by generating a control signal to control an engine controller 360. Controller 335 and engine controller 360 are shown in FIG. 4 as being separate blocks, but these separate blocks in the block diagram of FIG. 4 are intended to show functionality. In various embodiments, any suitable number of controllers can be employed to accomplish the functions described for controllers 335 and 360. These controllers can be implemented in a single component, in two separate components, or in three or more components as may be desirable.

In exemplary embodiments, electronic controller 335 is configured to monitor the power in each of the implement circuit 320 and drive circuit 325 (by, for example, measuring pressures at the outlet of the pumps and displacements of the pumps), and to adjust pump flow in pumps 310 and 315 to manage engine power consumption. In one such example, because the displacement of pump 310 to the implement circuit 320 and the displacement of pump 315 to the drive circuit 325 can be separately controlled, the configuration of controller 335 allows the controller to control the prioritization of flow of oil to the two circuits by controlling displacements of the pumps individually. In exemplary embodiments, the prioritization of power depends on the current working mode of the machine, for example according to the following criteria.

When an implement or attachment is being operated (signaled by the auxiliary hydraulics being turned "on" or auxiliary flow is being directed to the attached implement), power is prioritized to the implement circuit 320. In other words, power is taken away from the drive circuit 325 first by reducing the output of pump 315; and when the auxiliary hydraulics are turned "off" (when auxiliary flow is not being directed to the attached implement), power is prioritized to the drive circuit 325 and taken away from the implement circuit 310 first by reducing the output of pump 310. These power prioritizations can be in effect at all times or in other embodiments, when the power commanded by the user is greater than the capacity of the engine. Thus, by providing power to the implement circuit when an implement is being used, the power machine can more effectively operate the function of the implement than it would otherwise be able to, if more power is being provided to the drive circuit. Likewise, in situations where implements are not being used, it is more advantageous to provide power to the drive function. This control criteria identifies a way to effectively prioritize power for efficient implement use.

While one set of control criteria for prioritizing power and controlling separate implement and drive pumps is described above, other criteria can be used as well or instead.

Although the present invention has been described with reference to preferred embodiments, workers skilled in the art will recognize that changes may be made in form and detail without departing from the spirit and scope of the invention.

What is claimed is:

1. A power machine having a frame, an engine supported by the frame, and further comprising:

a structure for receiving one of a plurality of attachable implements capable of being operated by the power machine;

an implement circuit configured to selectively provide power to an implement that is operably coupled to the power machine;

an implement pump driven by the engine and configured to supply a first variable displacement flow of pressurized hydraulic fluid to the implement circuit;

a drive circuit including at least one drive motor;

a drive pump driven by the engine and configured to supply a second variable displacement flow of pressurized hydraulic fluid to the drive circuit;

a controller coupled to the implement pump and the drive pump and configured to selectively provide power to the implement circuit and the drive circuit in response to signals from user input devices, the controller being configured to monitor power in each of the implement circuit and the drive circuit and to generate control signals to control prioritization of flow of hydraulic fluid to the implement circuit and to the drive circuit by individually controlling the first variable displacement flow of the implement pump and the second variable displacement flow of the drive pump in order to manage engine power consumption, wherein the controller is further configured such that, when the controller is free from any signals from the user input devices to provide power to the implement that is operably coupled to the power machine, power to the drive circuit is prioritized higher than power to the implement circuit and the controller controls the implement pump to reduce the first variable displacement flow of the implement pump.

2. The power machine of claim 1, wherein the controller is configured to control prioritization of flow of hydraulic fluid to the implement circuit and to the drive circuit as a function of a working mode of the power machine.

3. The power machine of claim 2, wherein the controller is configured such that, when the controller, in response to signals from user input devices, makes power available for the attached implement, power to the implement circuit is prioritized higher than any power that is provided to the drive circuit and the controller controls the drive pump to reduce the second variable displacement flow of the drive pump.

4. The power machine of claim 1 and further comprising:

a lift arm assembly pivotally coupled to the frame;

an implement carrier pivotally coupled to the lift arm assembly and configured to have an implement coupled thereto; and wherein the implement circuit further includes:

a lift actuator, coupled between the frame and the lift arm assembly and configured to raise and lower the lift arm assembly; and a tilt actuator pivotally coupled between the lift arm assembly and the implement carrier and configured to rotate the implement carrier relative to the lift arm assembly.

5. The power machine of claim 1, wherein the controller is configured to control prioritization of flow of hydraulic fluid to the implement circuit and to the drive circuit at all times during power machine operation.

6. The power machine of claim 1, wherein the controller is configured to control prioritization of flow of hydraulic fluid to the implement circuit and to the drive circuit only when power, commanded by an operator using the user input, to be provided to one or both of the implement circuit and the drive circuit, is greater than a capacity of the engine.

7. The power machine of claim 1, and further comprising a first sensor configured to monitor power in the implement circuit and a second sensor configured to monitor power in the drive circuit, the first and second sensors providing feedback to the controller for use in generating control signals for controlling the implement pump and the drive pump.

8. A power machine comprising:

a frame;

an engine;

a lift arm assembly pivotally coupled to the frame;

an implement carrier pivotally coupled to the lift arm assembly and configured to have an implement coupled thereto;

an implement circuit, comprising:

a lift actuator, coupled between the frame and the lift arm assembly and configured to raise and lower the lift arm assembly; and a tilt actuator pivotally coupled between the lift arm assembly and the implement carrier and configured to rotate the implement carrier relative to the lift arm assembly; and auxiliary hydraulic components including any implement actuator of the implement coupled to the implement carrier;

an implement pump driven by the engine and configured to supply a first variable displacement flow of pressurized hydraulic fluid to the implement circuit;

a drive circuit including at least one drive motor;

a drive pump driven by the engine and configured to supply a second variable displacement flow of pressurized hydraulic fluid to the drive circuit;

a controller coupled to the implement pump and the drive pump, the controller configured to generate control signals to control the implement pump and the drive pump to prioritize flow of hydraulic fluid to the implement circuit and to the drive circuit by individually controlling the first variable displacement flow of the implement pump and the second variable displacement flow of the drive pump, wherein the controller is further configured such that, when the auxiliary hydraulic components including any implement actuator of the implement coupled to the implement carrier are turned off and flow of hydraulic fluid is not being directed to the auxiliary hydraulic components, power to the drive circuit is prioritized higher than power to the implement circuit and the controller generates the control signals to control the implement pump to reduce the first variable displacement flow of the implement pump.

9. The power machine of claim 8, wherein the controller is configured to generate the control signals to control the implement pump and the drive pump to prioritize flow of hydraulic fluid to the implement circuit and to the drive circuit as a function of a working mode of the power machine.

10. The power machine of claim 9, wherein the controller is configured such that, when the auxiliary hydraulic components including any implement actuator of the implement coupled to the implement carrier are turned on or flow of hydraulic fluid is being directed to the auxiliary hydraulic components, power to the implement circuit is prioritized higher than power to the drive circuit and the controller generates the control signals to control the drive pump to reduce the second variable displacement flow of the drive pump.

11. The power machine of 8, and further comprising a user input coupled to the controller and configured to command that power be supplied, in the form of flow of hydraulic fluid, to one or both of the implement circuit and the drive circuit.

12. The power machine of claim 11, wherein the controller is configured to prioritize flow of hydraulic fluid to the implement circuit and to the drive circuit at all times during power machine operation.

13. The power machine of claim 11, wherein the controller is configured to prioritize flow of hydraulic fluid to the implement circuit and to the drive circuit only when power, commanded by an operator using the user input, to be provided to one or both of the implement circuit and the drive circuit, is greater than a capacity of the engine.

14. The power machine of claim 8, and further comprising a first sensor configured to monitor power in the implement circuit and a second sensor configured to monitor power in the drive circuit, the first and second sensors providing feedback to the controller for use in generating the control signals for controlling the implement pump and the drive pump.

* * * * *